US005566611A

United States Patent [19]

Scheucher et al.

[11] Patent Number: 5,566,611

[45] Date of Patent: Oct. 22, 1996

[54] APPARATUS FOR SEPARATING LIQUID FROM FIBROUS SUSPENSIONS

[75] Inventors: Peter Scheucher, Kumberg; Gerhard Heindler; Walter Schinninger, both of Graz; Gerhard Paier, Krottendorf-Gaisfeld; Peter Mraz, Klosterneuburg, all of Austria

[73] Assignee: Andritz-Patentverwaltungs-Gesellschaft m.b.H, Graz, Austria

[21] Appl. No.: 335,859

[22] PCT Filed: May 14, 1993

[86] PCT No.: PCT/AT93/00083

§ 371 Date: Mar. 20, 1995

§ 102(e) Date: Mar. 20, 1995

[87] PCT Pub. No.: WO93/23239

PCT Pub. Date: Nov. 25, 1993

[30] Foreign Application Priority Data

May 15, 1992 [AT] Austria ..... A996/92

[51] Int. Cl.[6] ..... B30B 9/14; B30B 9/26

[52] U.S. Cl. ..... 100/127; 100/117; 100/297; 210/489; 210/498

[58] Field of Search ..... 100/117, 297, 100/126–129; 210/315, 415, 489, 498

[56] References Cited

U.S. PATENT DOCUMENTS

| | | | |
|---|---|---|---|
| 1,311,160 | 7/1919 | French | 100/127 |
| 1,354,528 | 10/1920 | Wertenbruch | 100/127 |
| 1,696,401 | 12/1928 | Hiller | 100/150 |
| 2,800,072 | 7/1957 | Vandenburgh | 100/127 |
| 2,910,183 | 10/1959 | Hayes | 210/498 |
| 3,021,254 | 2/1962 | Helversen et al. | 100/127 |
| 3,126,818 | 3/1964 | Koelsch | 100/117 |
| 3,550,775 | 12/1970 | Cooley | 100/127 |
| 3,812,972 | 5/1974 | Rosenblum | 210/498 |
| 4,358,370 | 11/1982 | Jameson et al. | 210/498 |
| 4,446,788 | 5/1984 | Molnar | 100/117 |
| 5,200,072 | 4/1993 | Frejborg et al. | 210/498 |
| 5,259,512 | 11/1993 | Czerwoniak | 210/415 |

FOREIGN PATENT DOCUMENTS

| | | |
|---|---|---|
| 50157 | 1/1940 | France . |
| 1198176 | 12/1959 | France . |
| 1260202 | 3/1961 | France . |
| 112321 | 8/1900 | Germany . |
| 369573 | 2/1923 | Germany . |

*Primary Examiner*—Stephen F. Gerrity
*Attorney, Agent, or Firm*—Chilton, Alix & Van Kirk

[57] ABSTRACT

The invention relates to an apparatus for separating liquid from solids-liquid mixtures, in particular fibrous matter suspensions, more particularly under pressure, comprising a solid retention component having liquid passages, composed of a screen and a supporting body for the screen. The invention is primarily characterized in that the solids retention component is designed in multiple layers, that layer which faces the solids-liquid mixture taking the form of a screen (3) with apertures (7) and that layer which faces away from the solids-liquid mixture being designed as a support body (4) having slot-shaped apertures (5). The invention furthermore relates to an apparatus according to the present invention in the form of a worm press.

44 Claims, 10 Drawing Sheets

APPARATUS FOR SEPARATING LIQUID FROM FIBROUS SUSPENSIONS

BACKGROUND OF THE INVENTION

The invention relates to an apparatus for separating liquid from fibrous matter suspensions, comprising a multiple-layered solid retention means having liquid passages, composed of a screen and a supporting body for the screen, as well as an apparatus in the form of a worm press.

An apparatus of this type is known from DE-C-112321. The press there described serves for pressing liquids from solids, such as pressing of juices, water or oil from suitable substances. The solids retention means of that press is of multiple-layered construction and comprises an inner envelope having short slots arranged longitudinally in parallel rows. A woven wire fabric is provided above this envelope, supported by yet a further envelope. In further known apparatus of this kind perforated plates were usually used as a screen. These are usually fitted on a support means, the support means comprising countersunk holes into each of which a plurality of the apertures of the screen enter. This involves a great problem in that the perforation spacings of the screen and of the support means can virtually not be made to match, as a result of which a major part of the perforations of the screen terminate on the surface of the support means and cannot drain. In the event of fibrous suspensions, the further problem arises that the perforations of the support means become blocked by the fibres, as a result of which the dewatering capacity of the apparatus greatly diminishes. Here to provide a remedy, is one of the objects of the invention.

SUMMARY OF THE INVENTION

The invention is primarily characterised in that, that layer which faces the fibrous suspension takes the form of a screen with apertures and that layer which faces away from the solids-liquid mixture is designed as a support body having slot-shaped apertures and that at least one free space for liquid distribution is provided between the screen and the supporting body. The result of this is that the liquid passages of one layer are not obscured by an adjoining layer which would interfere with the passage of liquid.

According to an advantageous embodiment of the invention, the slot-shaped passages of the supporting body are arranged parallel to one another, uniformly distributed over its surface and preferably arranged in mutually staggered rows.

Preferably according to the invention the cross section of the passages of the supporting body in downstream direction of the liquid increases. This substantially prevents blocking of the passages by fibres.

Expediently, according to the invention, the free space is provided in the form of channels between the screen and the supporting body. The formation of channels between the screen and the supporting body actually makes possible effective cleaning from outside. For that purpose water is introduced by means of a flat jet nozzle into one of the slot-shaped passages, is pressed through the channels and forced out through the next slots.

Advantageously, according to the invention, the channels are formed by spacers, in particular battens fitted between the screen and the supporting body.

According to a further advantageous embodiment of the invention, the channels are formed by grooves provided in the screen. This permits reduction of the structural height of the apparatus.

According to an advantageous embodiment of the invention, the channels are arranged at least essentially transversely in relation to the slot shaped passages of the supporting body. In this manner an optimal drainage of the liquid is attained, such that with the apparatus a high dewatering capacity is attainable.

In the past a number of passages were obscured by the mounting flanges, whereby the dewatering capacity was reduced.

Advantageously, according to the present invention, channels are provided in the marginal region of the supporting body in the form of grooves provided in the supporting body, extending longitudinally to and as a continuation of the apertures.

According to an advantageous embodiment of the invention, the passages through the screen increase in cross section in the drainage direction of the liquid. In this context it is advantageous if the passages are directed at right angles to the screen surface.

Advantageously, according to the invention, bores are provided in the screen serving as passages. According to a funher advantageous embodiment of the invention, slots are provided in the screen serving as passages.

Expediently, according to the invention, the slot-shaped passages in the supporting body are provided at right angles to a surface of the supporting body.

Advantageously, according the invention, the longitudinal direction of the slob in the screen is directed at right angles to the longitudinal direction of the slot-shaped passages through the supporting body.

Advantageously, according to the invention, the inner cross section respectively the aperture width of the passages in the screen and the slot-shaped passages through the supporting body are at least partly in alignment. Such a design is particularly necessary for the functioning of the apparatus according to the invention or for the apparatus according to the invention taking the form of a worm press, in the absence of an interspace between the screen and the supporting body.

According to an advantageous embodiment of the invention, the solids retention means takes the form of a hollow cylinder or a hollow frusto-conical body. In that case it may be advantageous if the slot-shaped passages through the supporting body are normal to the generatrics of the hollow cylinder or hollow frusto-conical body. Alternatively, it may also be advantageous, if the slot-shaped passages in the supporting body are orientated approximately in the direction of the generatrics of the hollow cylinder or hollow frusto-conical body.

According to an advantageous embodiment of the invention, the passages through the screen enter into grooves of the screen or are interconnected by grooves, such grooves being provided on the side of the screen facing the supporting body, and advantageously extend transversely to the slot-shaped passages of the supporting body and preferably approximately in the direction of the generatrics. This design permits an onward conduction of liquid if a passage through the screen is provided over a closed region of the supporting body and directly bears thereon. The liquid is conducted onwards by grooves on the surface of the supporting body to the next following slot-shaped passage through the supporting body and can drain as a result.

According to another advantageous embodiment of the invention, the solids retention means is of planar design.

The invention also relates to an apparatus according to the present invention in the form of a worm press. The apparatus in the form of the worm press is primarily characterised in that the at least one worm of the worm press is surrounded by the solids retention means in the form of a hollow cylinder or conical body.

The apparatus according to the invention may be employed advantageously, particularly when dewatering fibrous suspensions introduced into the housing and subjected to appropriate pressure by the worm.

Advantageously the cylinder wall or conical wall in the worm press, according to the invention, consists of a plurality of parts, in particular of a plurality of successive cylindrical or conical and frusto-conical walls.

At the end of the worm, the dewatering can no longer proceed outwardly. For that reason for optimal dewatering in the outlet region of the hollow drum a screen for dewatering inwardly into the cavity is provided.

Advantageously, according to the invention, the worm of the worm press is provided on the outer periphery of a hollow drum and the hollow drum in the terminal region of material conveyance in the worm press comprise a cylindrical screen section.

This screen is designed analogously to the screen of the apparatus, ie. it more particularly comprises passages, the cross sections of which flare towards the interior (in the direction of the axis).

Advantageously the passages of the cylindrical screen section of the worm press have a cross section which increases in the direction of draining the liquid in the direction towards the axis of the drum.

In order to provide as large a cross section for the drainage of the liquid, the hollow drum of the worm press is, according to the invention, in its terminal region, is designed with a conical taper, the conical drum periphery being surrounded by the cylindrical screen section, or where applicable by a solid cylindrical wall following thereon.

Advantageously and in accordance with the invention, the worm press has, fixed in the terminal region to the solid cylinder wall, preferably transversely to the longitudinal axis, partition walls which jointly with the screen cylinder section and, where applicable, the solid cylinder wall and with the drum wall form channels for the discharge of the liquid.

Advantageously and in accordance with the invention, the worm press comprises at the end of the channels an overflow for liquid.

Advantageously and in accordance with the invention, the worm press comprises at the end of the channels rinsing means, preferably spray nozzles, for cleaning the channels, in particular of entrained fibres.

According to an advantageous embodiment of the worm press, pressure generating or regulating means, in particular flaps, are provided for pressure generation or regulation in the solids-liquid mixture in the terminal region outside of the screen cylinder section or solid cylinder wall as the case may be.

In what follows the invention will be explained with reference to the drawings. There is shown in: FIG. 1 a longitudinal section through an apparatus according to the invention, FIG. 2 an enlarged representation of detail 2 taken from FIG. 1, FIG. 3 a plan view onto the support means, FIG. 3*a* a plan view onto the support means with the screen there below, FIG. 4*a* a cross sectional segment of a circularly curved device in the region of a fastening flange, FIG. 4*b* a modification of FIG. 4*a*, FIG. 5*a* a cross section of a screen with bores and grooves, FIG. 5*b* a plan view on a developed representation of a screen for a circularly curved apparatus, FIG. 6 a modification of FIG. 4*a* ,*b* using spacers for the channels, FIG. 7 a longitudinal section through a worm press according to the invention, FIG. 8 a longitudinal section in the terminal region of the worm press, and FIG. 9 a cross sectional segment in the terminal region of the worm press.

BRIEF DESCRIPTION OF THE DRAWING

In the FIGS. 1 denotes the space in which the pressurized fibrous suspension to be dewatered is maintained, 2 the space into which the water of the fibrous suspension is pressed, 3 the screen required for the dewatering process, 4 the associated supporting body, 5 the passages of the supporting body 4, 6 the channels between the screen 3 and supporting body 4 and 7 the passages through the screen 3.

DESCRIPTION OF THE PREFERRED EMBODIMENT

Figure 1:
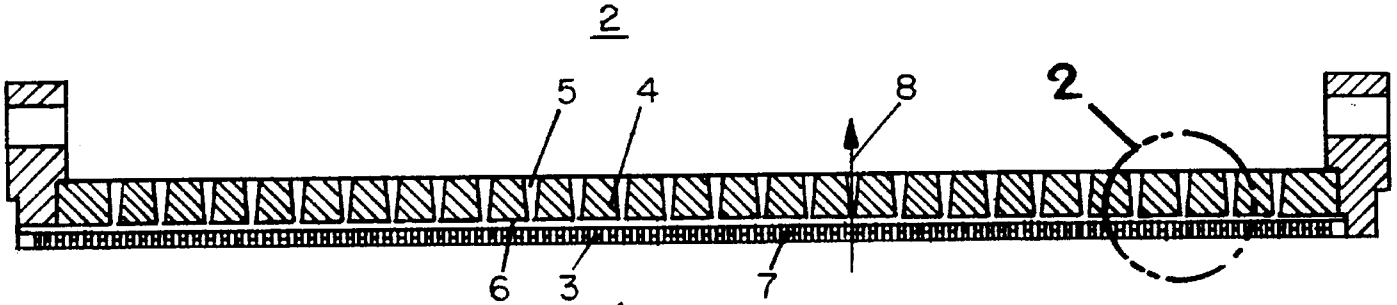

FIG. 1 represents an apparatus according to the invention, by means of which from a fibrous suspension to be dewatered, maintained in the space 1, with the application of pressure, water is transferred in the direction of the arrow 8 into the space 2 and is discharged from there. Solids, in particular fibres, are retained on the screen 3, while the liquid, predominantly water, passes through the passages 7. The liquid after having passed through the passages 7 of the screen 3 becomes distributed in the channels 6, provided between the screen 3 and the supporting body 4 and enters through the passages 5 of the supporting body 4 into the space 2. Due to suitable configurations of the passages 5 of the supporting body 4 and of the passages 7 in the screen 3, ie. cross sectional flaring in the downstream direction 8 of the liquid—any fibres which may have entered into the passages 5, 7 are readily removed by subsequent liquid under pressure and discharged with the liquid from the space 2.

Figure 2:
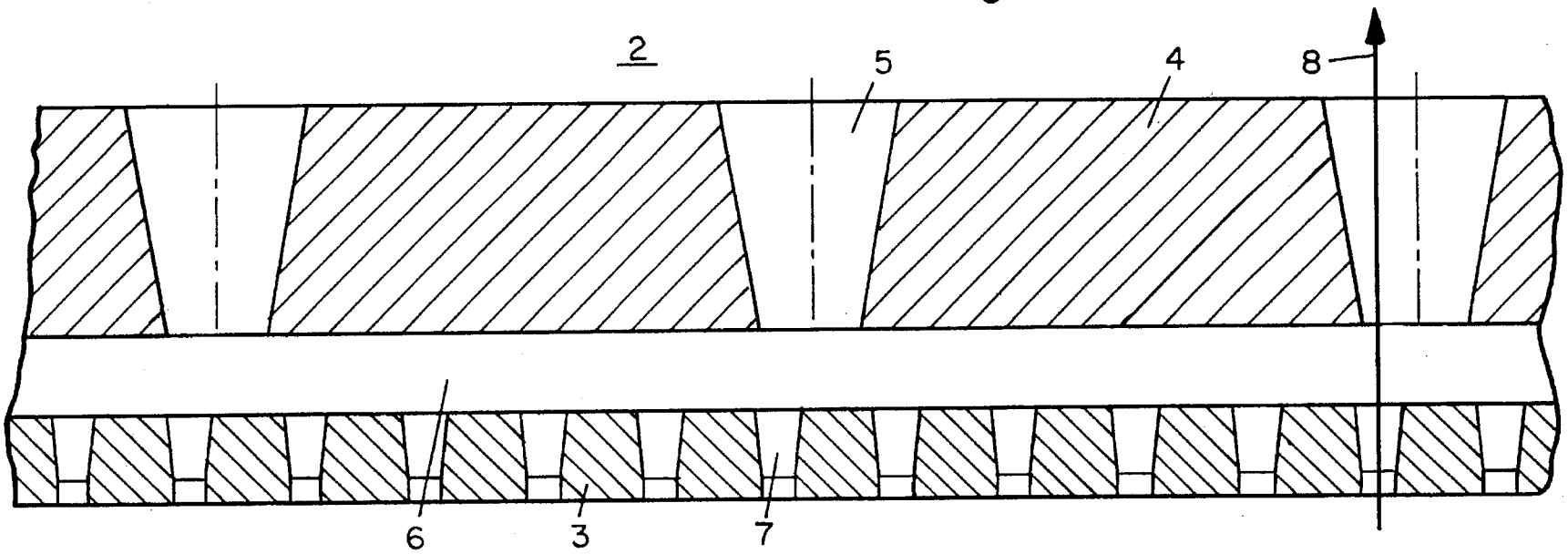

FIG. 2 shows an enlarged representation of detail 2 of FIG. 1, whereby the construction of the apparatus according to the invention is further elucidated.

Figure 3:
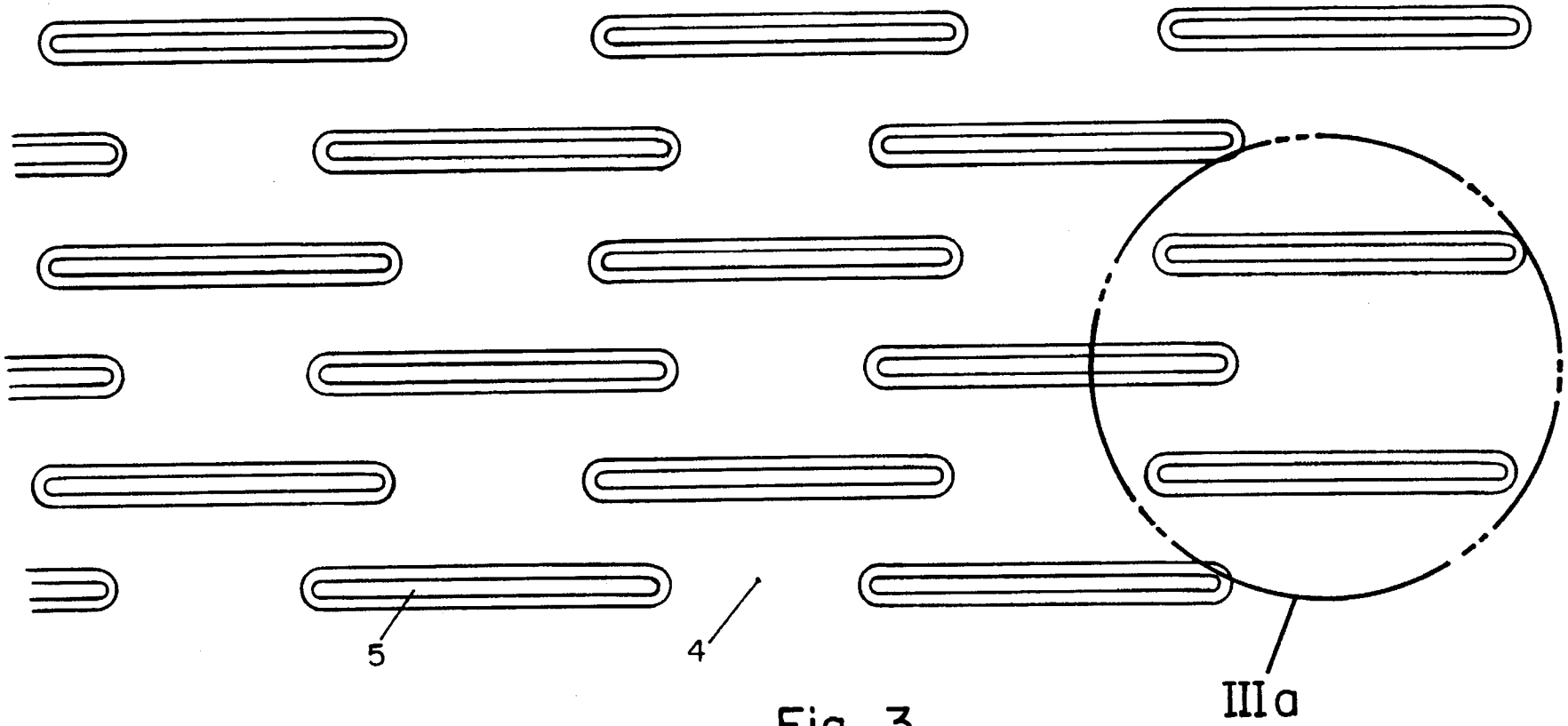

FIG. 3 shows a plan view onto the supporting body 4 taken from the direction of the space 2, ie. contrary to the direction of flow of the liquid, the configuration of the passages and their arrangement in the supporting body 4 being apparent. The double outlines of the passages 5 are due to the cross sectional change of the passages 5.

Figure 3A:
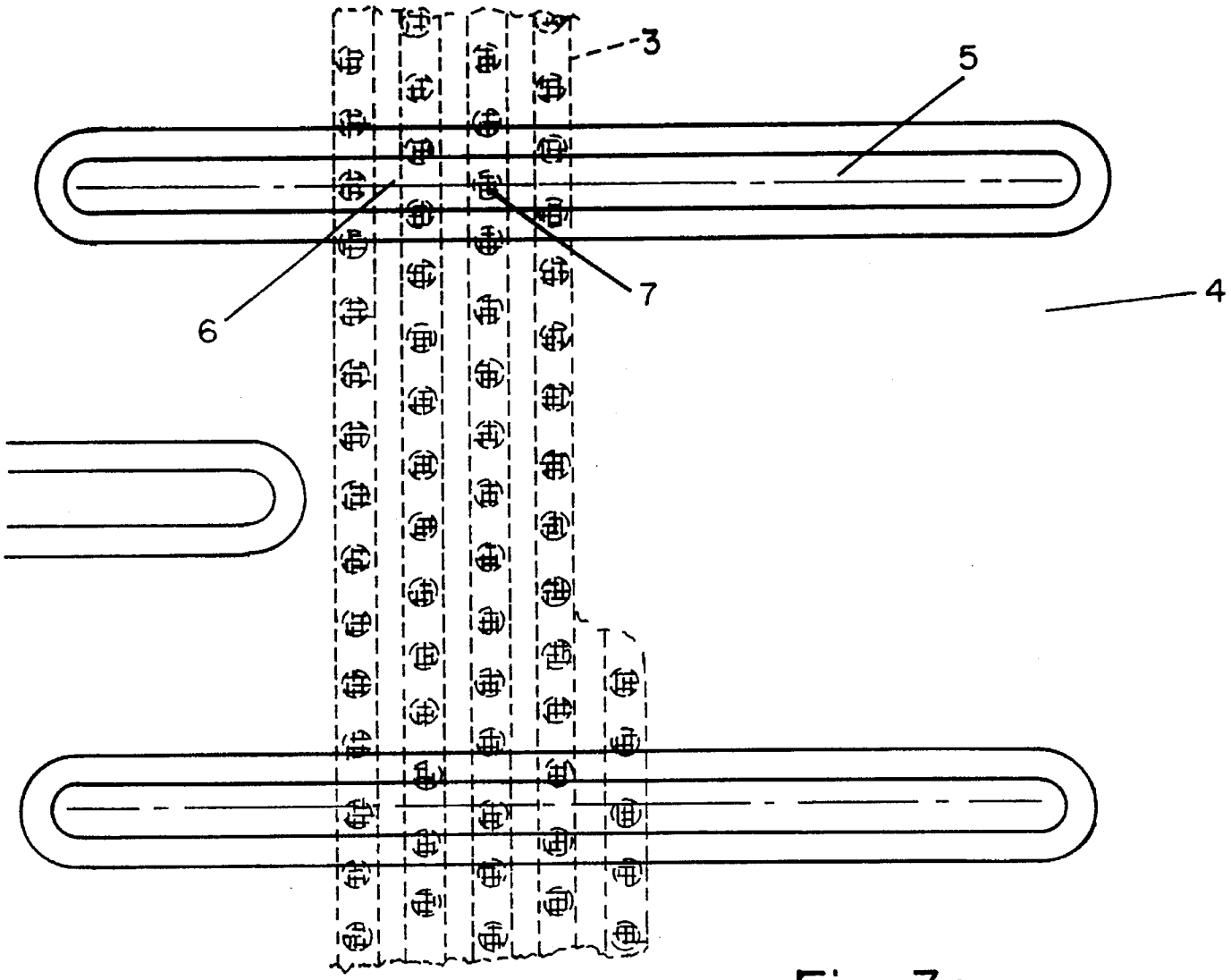

FIG. 3*a* shows a plan view onto the supporting body 4 including the screen 3 underneath it. It is apparent from this figure how the liquid passes from the passages 7 in the screen 3 via channel 6 into the passages 5 of the supporting body 4.

Figure 4A:
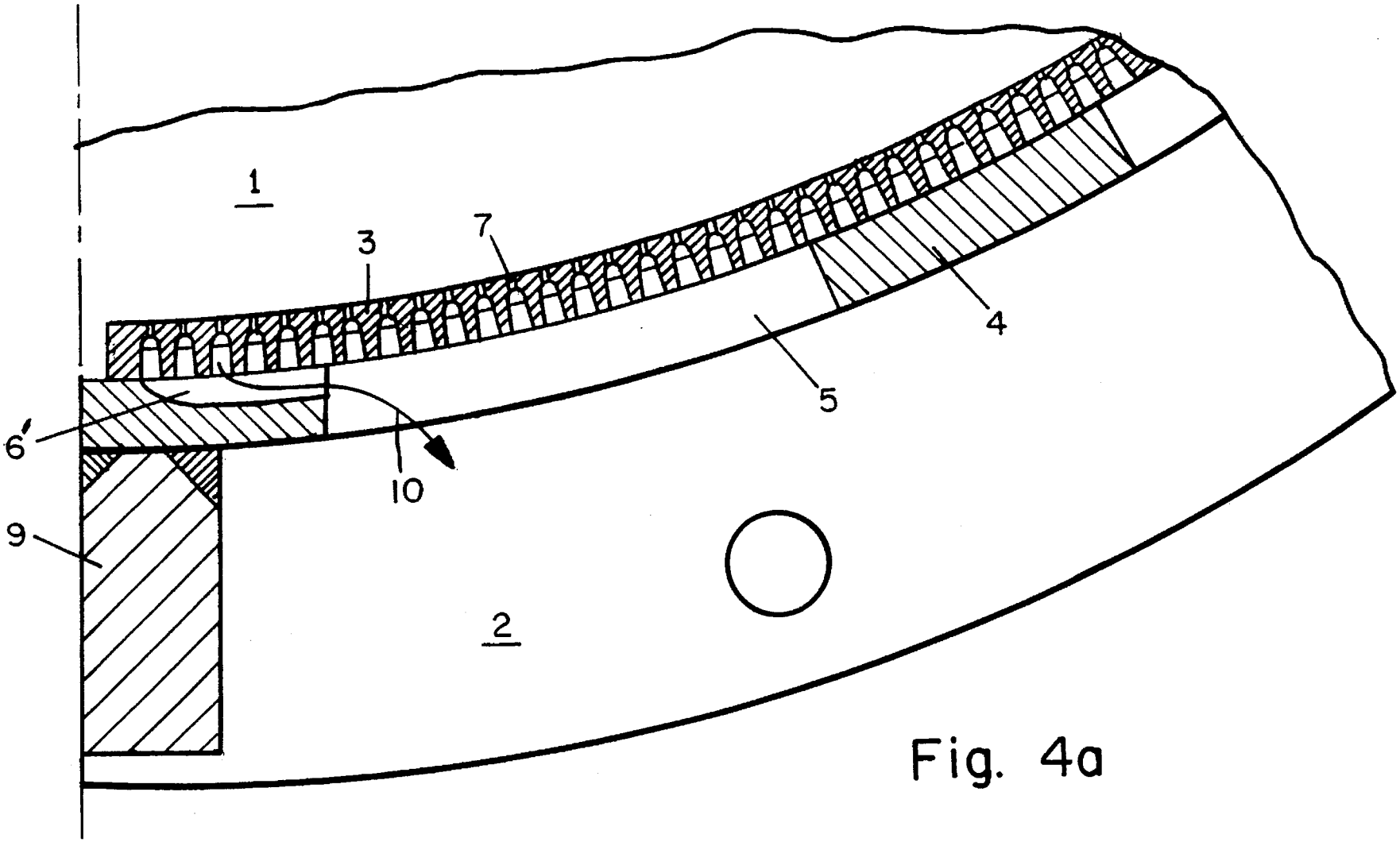
Figure 4B:
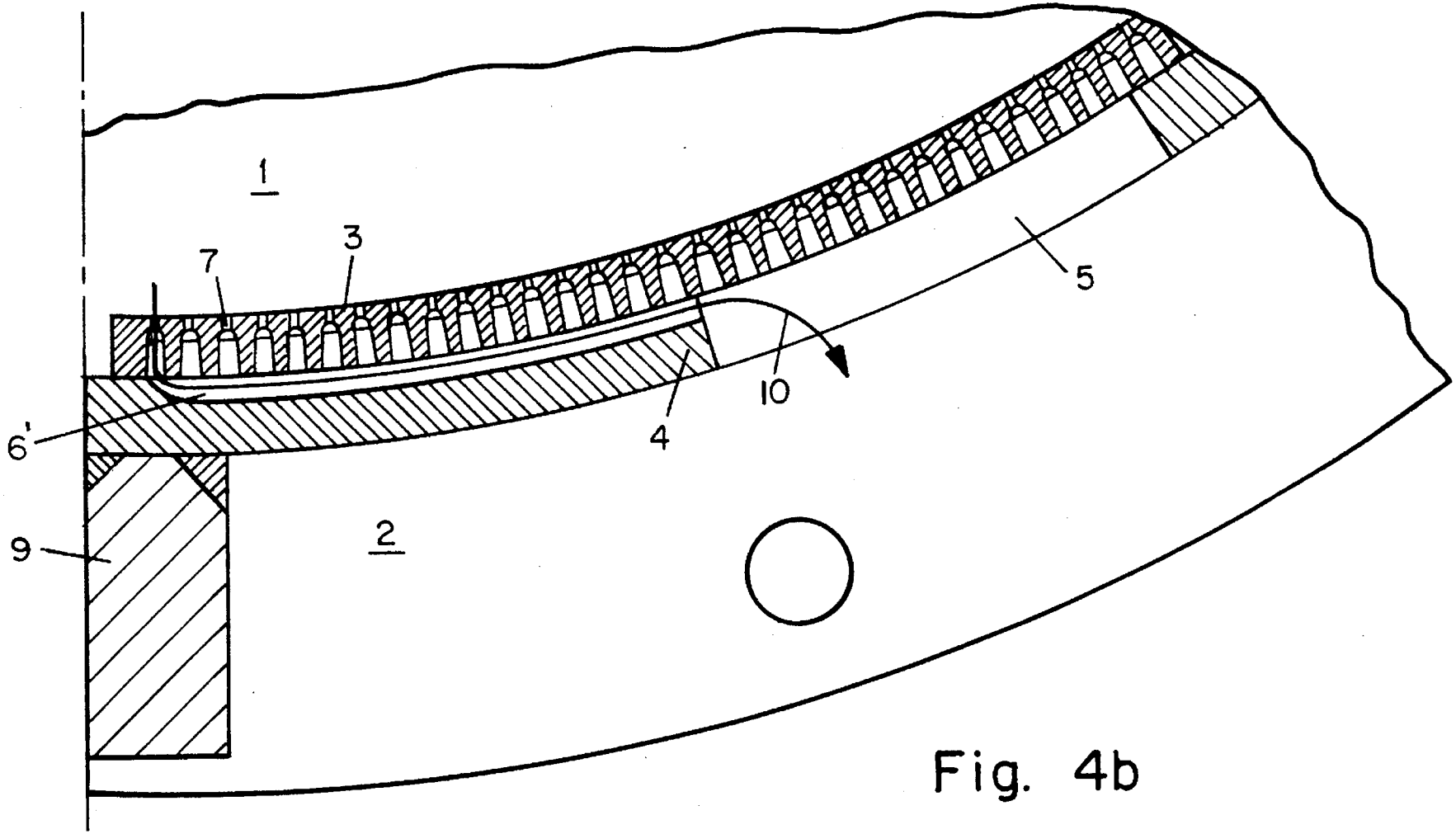

FIG. 4*a* and FIG. 4*b* show further advantageous embodiments of an apparatus according to the invention, which is of circular curvature. A flange required for fitting the apparatus to a housing or for fitting several of the apparatus to one another in conventional designs obscures a series of apertures whereby the dewatering capacity is reduced. Due to the design in accordance with the invention, it is now possible also for the liquid in the region of the flange 9 to enter through the passages 7 of the screen 3 into the channels 6' in the form of grooves and from there through the passages 5 of the supporting member 4 into the space 2 (as indicated by arrow 10).

Figure 5A:
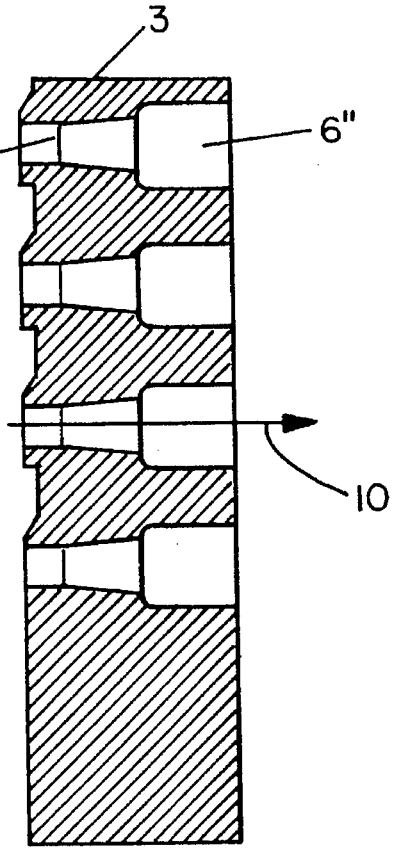

In FIG. 5*a* an advantageous embodiment of the screen 3 is illustrated, wherein the passages 7 of the screen 3 on that side which faces the solids-liquid mixture take the form of bores, which on the side of the screen 3 facing the support body 4 each enter into grooves 6". The liquid from the solids-liquid mixture passes through passages 7 in the screen 3 (as indicated by the arrow 10) to the support body (which is not illustrated). Whenever a passage 7 of the screen 3 is positioned above a blocked region of the support body 4 and lies directly thereon, the liquid can be passed on through the grooves 6" in the screen 3 along the surface of the support body 4 to the next following slot-shaped passage 5 in the support body 4. In this manner the drainage of liquid through the passage 7 of the screen 3 is ensured.

Figure 5B:
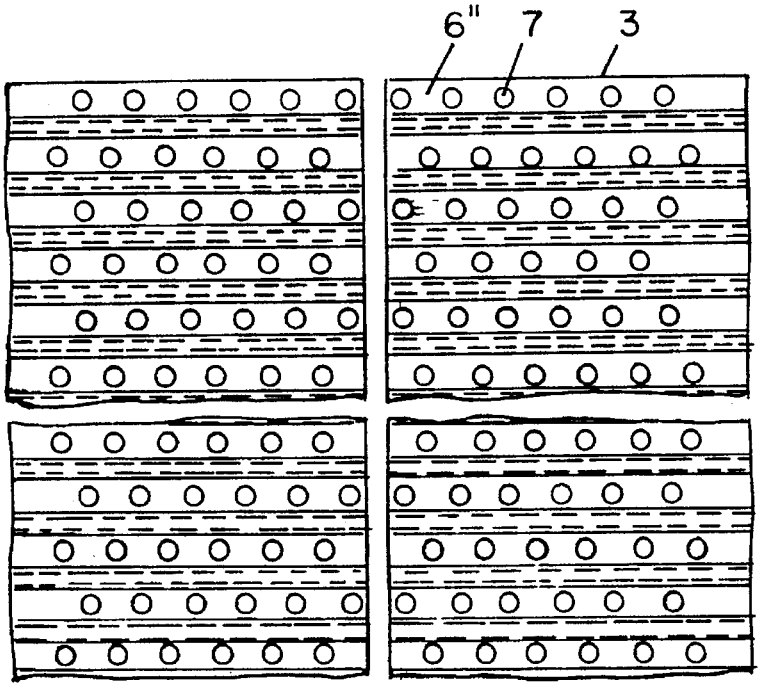

FIG. 5*b* shows a plan view onto a developed representation of a screen 3 for a circularly curved apparatus for the separation of liquid from solids-liquid mixtures. The passages 7 which comprise grooves 6" are equi-distantly arranged in a row, the passages 7 in adjoining rows being mutually staggered by half the distance of the passages 7.

Figure 6:
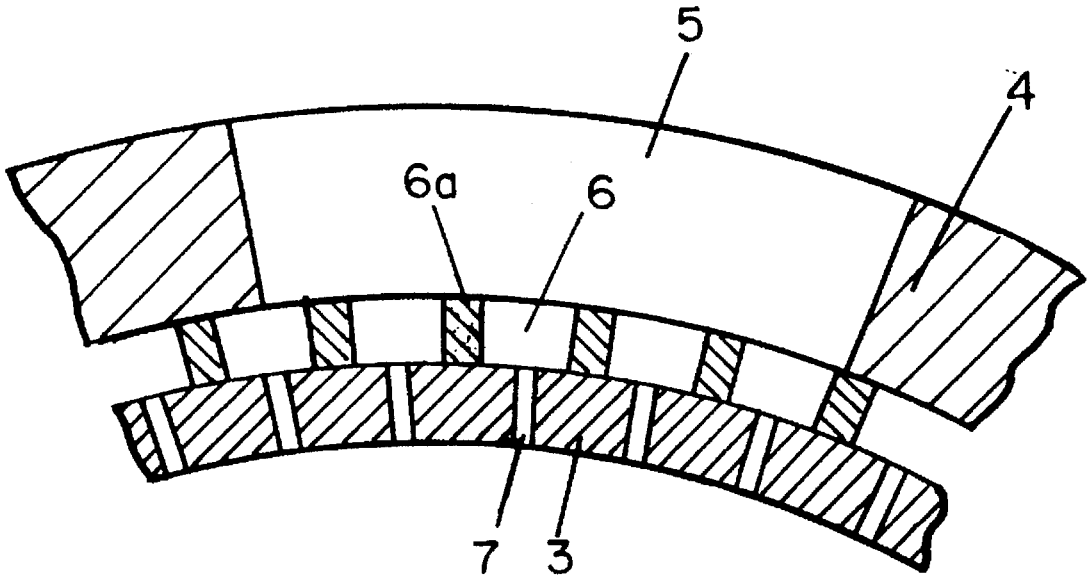

In FIG. 6 an advantageous embodiment of the channels 6 including spacers 6*a*, is illustrated. This is particularly expedient where large volumes of water arise or with special materials to be dewatered.

Figure 7:
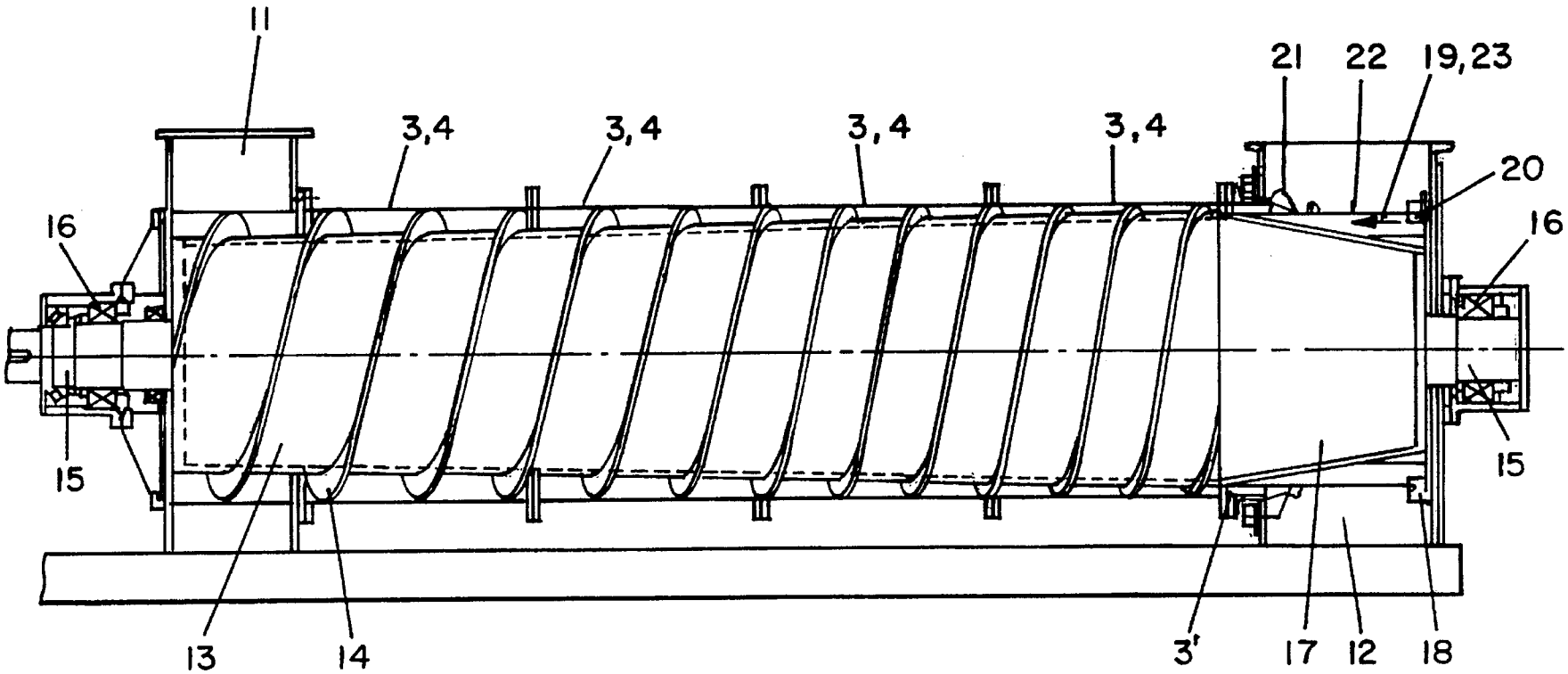

A worm press according to the present invention is illustrated in FIG. 7. The fibrous suspension to be dewatered is introduced by way of the feed nipple 11 into the worm chamber. This chamber is composed of a plurality of successive circularly curved screens 3 and supporting bodies 4 forming the cylinder wall. The worm 14 is in this context fitted on a hollow drum 13. At the ends of the drum 13 roller axial pins 15 are fitted by way of which the drum 13 (including the worm 14) is pivotally mounted in bearings 16. The material to be dewatered is subsequently discharged through a chum 12 from the worm press. The drum 13 comprises in the terminal region of the worm press a conically tapering drum wall 17. The drum wall 17, the partitions 19 and the solid cylinder wall 22 or where applicable the screen cylinder section 3' jointly form channels 23 for the discharge of the liquid. Finally, the liquid is discharged by way of an overflow 18 from the worm press.

For cleaning of the channels 23, rinsing means 20, eg. spray nozzles are provided. By means thereof a cleaning of the channels can take place even whilst in operation. Previously known designs of worm presses frequently had to be closed down and often even be taken apart for cleaning purposes.

In order to generate or regulate the pressure required in the terminal region of the worm press for separating the liquid from the solids suspension, appropriate flaps 21 are provided which can be regulated by means of hydraulic cylinders.

Figure 8:
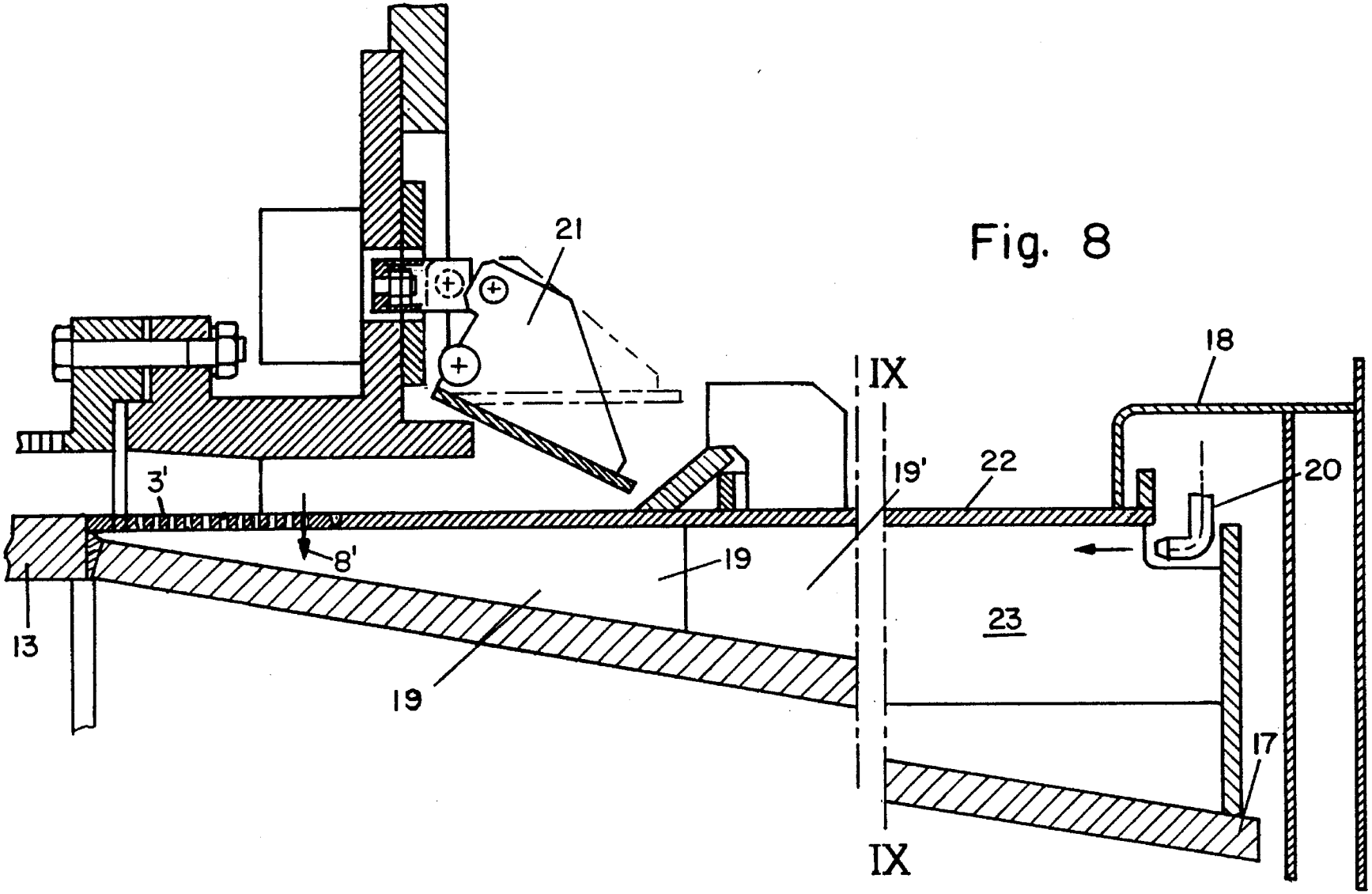

In FIG. 8 part of the terminal region of the worm press according to the invention, is illustrated in longitudinal section. Partitions 19, 19' fixed to the solid cylinder wall 22 directed parallel to the longitudinal axis and arranged in axial planes extend up to or nearly up to the drum wall 17 of the drum 13 which in that region has a conical taper. The drum wall 17, partitions 19 and solid cylindrical wall 22 or, where applicable, the cylindrical screen section 3' form channels 23 from which the liquid is discharged with the separation of solid matter when passing in the downstream direction 8' through the cylindrical screen section 3' from the worm press. Pressure can be applied to the fibrous suspension to be dewatered by means of the regulateable flap 21.

Figure 9:
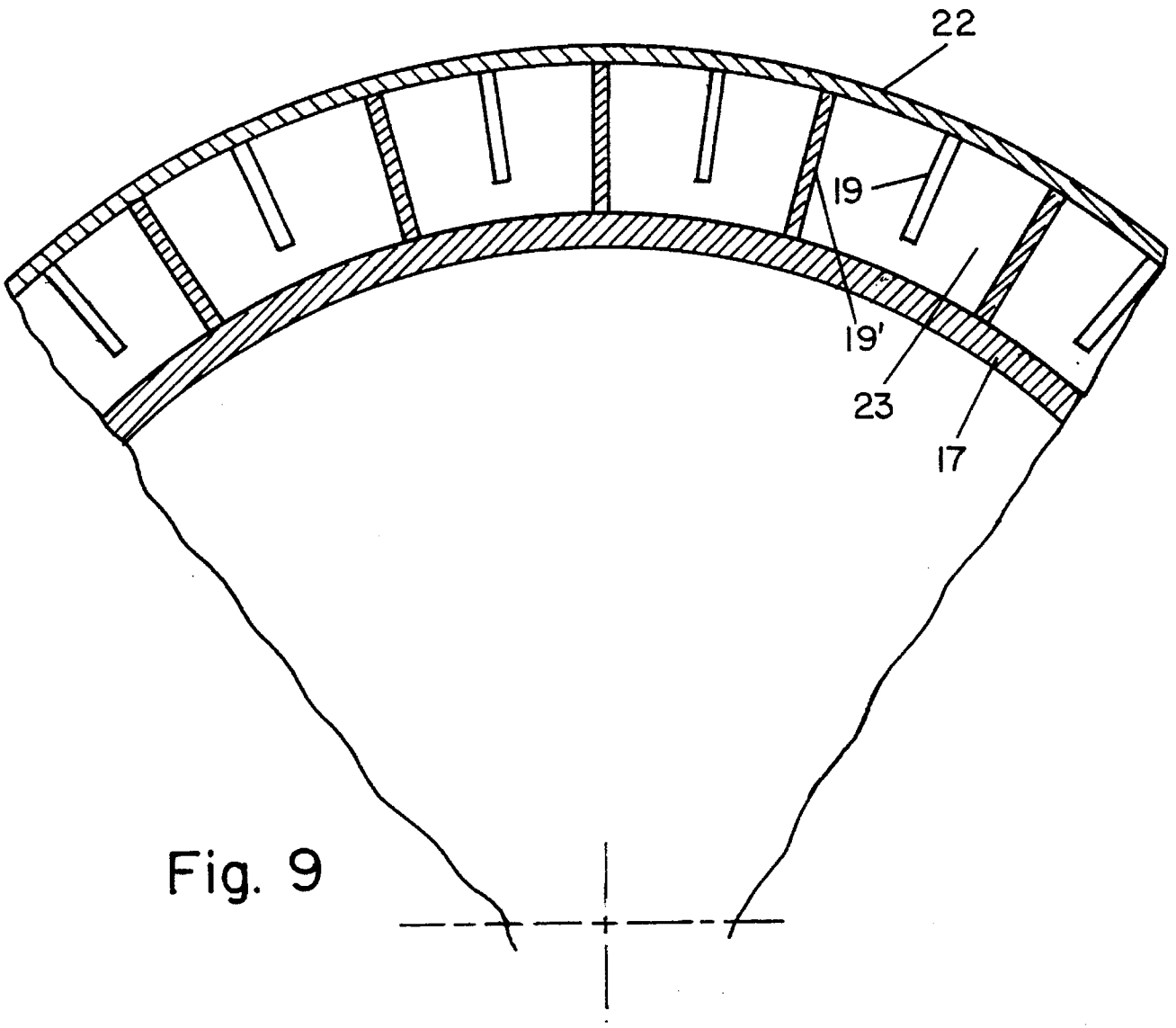

Finally FIG. 9 shows a cross sectional segment of the terminal region of the worm press including the individual channels 23 which are formed by the drum wall 17, the partitions 19 and 19' and the solid cylindrical wall 22.

The embodiments illustrated in the Figures serve to elucidate the invention. However, the invention is in no way limited to these embodiments.

We claim:

1. In an apparatus for separating liquid from fibrous pulp suspensions comprising a solids retention means of multiple-layered construction having liquid passages, wherein the layers are composed of a screen (3) and a supporting body (4) for the screen, the improvement wherein one layer, which faces the fibrous suspension, takes the form of the screen (3) with passages (7) which increase in cross-section in the drainage direction of the liquid, another layer, which faces away from the fibrous suspension, takes the form of the supporting body (4) having slot-shaped passages (5), and at least one free space for liquid distribution is provided between the screen (3) and the supporting body (4).

2. Apparatus according to claim 1, wherein the slot shaped passages (5) of the supporting body (4) are arranged parallel to one another, uniformly distributed over the surface of the supporting body.

3. Apparatus according to claim 2, wherein the cross section of each of the slot-shaped passages (5) of the supporting body (4) increases in the downstream direction (8) of liquid drainage.

4. Apparatus according to claim 2, wherein the free space is provided in the form of channels (6 and/or 6') between the screen (3) and the supporting body (4).

5. Apparatus according to claim 2, wherein the slot shaped passages are arranged in mutually staggered rows.

6. Apparatus according to claim 1, wherein the cross section of each of the slot-shaped passages (5) of the supporting body (4) increases in the downstream direction (8) of liquid drainage.

7. Apparatus according to claim 6, wherein the free space is provided in the form of channels (6 and/or 6') between the screen (3) and the supporting body (4).

8. Apparatus according to claim 1, wherein the free space is provided in the form of channels (6 and/or 6') between the screen (3) and the supporting body (4).

9. Apparatus according to claim 8, wherein the channels (6) are formed by spacers (6*a*) between the screen (3) and the supporting body (4).

10. Apparatus according to claim 8, wherein the channels (6) are formed by grooves (6") provided in the screen (3).

11. Apparatus according to claim 8, wherein the channels (6) are arranged substantially transversely in relation to the slot-shaped passages (5) of the supporting body (4).

12. Apparatus according to claim 8, wherein the channels (6') are provided in the form of grooves in the supporting body (4) extending to and as a continuation of the passages (5) in the supporting body.

13. The apparatus according to claim 1, wherein the passages (7) are directed at right angles to the screen surface.

14. Apparatus according to claim 1, wherein bores are provided in the screen (3) serving as said passages (7).

15. Apparatus according to claim 1, wherein slots are provided in the screen (3) serving as said passages (7).

16. Apparatus according to claim 15, wherein the slots (7) in the screen (3) are elongated at right angles to the slot-shaped passages (5) through the supporting body (4).

17. Apparatus according to claim 1, wherein the slot-shaped passages (5) in the supporting body (4) are provided at right angles to a surface of the supporting body (4).

18. Apparatus according to claim 1, wherein the inner cross section of the passages (7) in the screen (3) and of the slot-shaped passages (5) through the supporting body (4) are at least partly in alignment.

19. Apparatus according to claim 1, wherein the solids retention means takes the form of a hollow cylinder.

20. Apparatus according to claim 19, wherein the slot-shaped passages (5) through the supporting body (4) are normal to the surface of the hollow cylinder.

21. Apparatus according to claim 19, wherein the slot-shaped passages (5) in the supporting body (4) are oriented approximately in the direction of the surface of the hollow cylinder.

22. Apparatus according to claim 1, wherein the passages (7) through the screen (3) enter into grooves (6") on the side of the screen (3) facing the supporting body (4).

23. Apparatus according to claim 22, wherein said grooves extend transversely to the slot-shaped passages.

24. Apparatus according to claim 1, wherein the solids retention means is of a planar design.

25. Apparatus according to claim 1, wherein the solids retention means takes the form of a hollow frustoconical body.

26. Apparatus according to claim 25, wherein the slot-shaped passages (5) through the supporting body (4) are normal to the surface of the hollow frustoconical body.

27. Apparatus according to claim 25, wherein the slot-shaped passages (5) in the supporting body (4) are oriented approximately in the direction of the surface of the hollow frustoconical body.

28. In a worm press for removing liquid from a liquid-solids suspension by conveying the suspension with a worm which rotates about a longitudinal axis and is surrounded at least in part by a hollow wall defining solids retention means of multiple layered construction having liquid passages, whereby liquid in said suspension is drained in a direction through said passages as the suspension is pressed between the worm and the solids retention means, wherein said solids retention means comprises:

a screen constituting one of said layers and defining screen passages, which extend outwardly from an inner side of the screen facing the suspension to an outer side facing away from the suspension, the passages through the screen increasing in cross-section in the drainage direction of the liquid;

a supporting body constituting another of said layers and having an inner surface supporting the outer side of the screen and slot-shaped passages from the inner surface to an outer surface, for the drainage of said liquid; and a free space between the screen and the supporting body, for distributing the liquid from the passages in the screen to the passages in the supporting body.

29. Worm press according to claim 28, wherein the slot shaped passages (5) of the supporting body (4) are arranged parallel to one another, uniformly distributed through the supporting body inner surface.

30. Worm press according to claim 28, wherein the cross section of each of the slot-shaped passages (5) of the supporting body (4) increases in the direction (8) of liquid drainage.

31. Worm press according to claim 28, wherein the free space is provided in the form of channels (6 and/or 6') between the screen (3) and the supporting body (4).

32. Worm press according to claim 31, wherein the channels (6) are formed by spacers (6*a*) between the screen (3) and the supporting body (4).

33. Worm press according to claim 31, wherein the channels (6) are formed by grooves (6") provided in the screen (3).

34. Worm press according to claim 31, wherein the channels (6) are arranged substantially transversely in relation to the slot-shaped passages (5) of the supporting body (4).

35. Worm press of claim 28, wherein bores are provided in the screen (3) serving as said screen passages (7).

36. Worm press of claim 28, wherein slots are provided in the screen (3) serving as said screen passages (7).

37. Worm press of claim 28, wherein the passages (7) through the screen (3) enter into grooves (6") on the outer side of the screen (3), facing the supporting body (4).

38. Worm press according to claim 28, wherein the worm of the worm press is provided on the outer periphery of a hollow drum (13) and the hollow drum in the terminal region of material conveyance in the worm press includes a cylindrical terminal screen section (3').

39. Worm press according to claim 38, wherein the terminal screen section has passages for draining liquid toward said longitudinal axis and the passages of the terminal screen section (3') have a cross section which increases in the direction of drainage (8').

40. Worm press according to claim 38, wherein the hollow drum (13) in its terminal region has a conical taper, the conical drum periphery (17) being surrounded by the cylindrical terminal screen (3') section followed by a solid cylindrical wall (22).

41. Worm press according to claim 40, wherein planar partitions (19, 19') are fixed in the solid cylinder wall (22), oriented transversely to and extending parallel with the longitudinal axis, and which jointly with the terminal screen cylinder section (3') and with the drum wall (17) form channels (23) for the discharge of the liquid from the terminal region.

42. Worm press according to claim 41, wherein at the end of the channels (23) an overflow (18) is provided for liquid.

43. Worm press according to claim 41, wherein at the end of the channels (23), rinsing means (20) are provided for cleaning the channels (23) of entrained fibers.

44. Worm press according to claim 40, wherein flat means (21) are provided for pressure regulation in the fibrous suspension in the terminal region outside of the terminal screen cylinder section (3').

* * * * *